US012163280B2

(12) United States Patent
Chevalley et al.

(10) Patent No.: US 12,163,280 B2
(45) Date of Patent: Dec. 10, 2024

(54) TWO-LAYER MULTI-STRAND CABLE HAVING AN IMPROVED SURFACE ENERGY-TO-BREAK

(71) Applicant: COMPAGNIE GENERALE DES ETABLISSEMENTS MICHELIN, Clermont-Ferrand (FR)

(72) Inventors: Marianna Chevalley, Clermont-Ferrand (FR); Stephane Laurent, Clermont-Ferrand (FR); Romain Barbat, Clermont-Ferrand (FR); Alexandre Gianetti, Clermont-Ferrand (FR); Benoit Renaux, Clermont-Ferrand (FR)

(73) Assignee: COMPAGNIE GENERALE DES ETABLISSEMENTS MICHELIN, Clermont-Ferrand (FR)

( * ) Notice: Subject to any disclaimer, the term of this patent is extended or adjusted under 35 U.S.C. 154(b) by 121 days.

(21) Appl. No.: 17/778,687

(22) PCT Filed: Nov. 5, 2020

(86) PCT No.: PCT/FR2020/051999

§ 371 (c)(1),
(2) Date: May 20, 2022

(87) PCT Pub. No.: WO2021/099712

PCT Pub. Date: May 27, 2021

(65) Prior Publication Data

US 2022/0412000 A1 Dec. 29, 2022

(30) Foreign Application Priority Data

Nov. 22, 2019 (FR) ..... 1913078

(51) Int. Cl.
*D07B 1/06* (2006.01)

(52) U.S. Cl.
CPC ..... *D07B 1/0633* (2013.01); *D07B 1/066* (2013.01); *D07B 2201/1044* (2013.01);
(Continued)

(58) Field of Classification Search
CPC .... D07B 1/0633; D07B 1/066; D07B 1/0626; D07B 1/165; D07B 1/0163;
(Continued)

(56) References Cited

U.S. PATENT DOCUMENTS 4,265,291 A 5/1981 Pommier
4,274,464 A 6/1981 Pommier
(Continued)

FOREIGN PATENT DOCUMENTS

FR 2419181 A1 10/1979
FR 2419182 A1 10/1979
(Continued)

OTHER PUBLICATIONS

International Search Report dated Feb. 3, 2021, in corresponding PCT/FR2020/051999 (4 pages).

*Primary Examiner* — Bao-Thieu L Nguyen
(74) *Attorney, Agent, or Firm* — VENABLE LLP

(57) ABSTRACT

A multi-strand cord (50) comprises an internal layer (CI) made up of K=1 internal strand (TI) having two layers (C1, C3), with the internal layer (C1) being made up of Q internal metallic threads (F1) and the external layer (C3) being made up of N external metallic threads (F3), and an external layer (CE) made up of L>1 external strands (TE) having two layers (C1', C3') wound around the internal layer (CI), with the internal layer (C1') being made up of Q' internal metallic threads (F1') and the external layer (C3') being made up of N' external metallic threads (F3'). The cord (50) has an energy-to-break per unit area ES≥145 N·mm$^{-1}$ with $$ES = \sum_{i=1}^{Nc} F_{mi} \times \sum_{i=1}^{Nc} A_{ti}/Nc \times Cfrag/D$$

where $$\sum_{i=1}^{Nc} F_{mi}$$

(Continued)

is the sum of the forces at break, $$\sum_{i=1}^{Nc} A_{ti}$$

is the sum of the total elongation, Cfrag is the coefficient of weakening, and D is the diameter.

16 Claims, 9 Drawing Sheets

(52) U.S. Cl.
CPC ..... *D07B 2201/2009* (2013.01); *D07B 2201/2039* (2013.01); *D07B 2205/3057* (2013.01); *D07B 2501/2046* (2013.01)

(58) Field of Classification Search
CPC .... D07B 2201/1044; D07B 2201/1068; D07B 2201/2009; D07B 2201/203; D07B 2201/2032; D07B 2201/2039; D07B 2201/2061; D07B 2205/3057; D07B 2207/4072; D07B 2501/2046; D07B 2401/2005; D07B 2801/12; D07B 2801/24
See application file for complete search history.

(56) References Cited

U.S. PATENT DOCUMENTS

| | | | | |
|---|---|---|---|---|
| 6,272,830 | B1 * | 8/2001 | Morgan | D07B 1/0613 57/902 |
| 6,863,103 | B1 * | 3/2005 | Masubuchi | B60C 9/2006 57/902 |
| 8,387,353 | B2 | 3/2013 | Mullebrouck et al. | |
| 11,319,666 | B2 * | 5/2022 | Clement | D07B 1/0613 |
| 11,346,049 | B2 * | 5/2022 | Clement | D07B 1/0633 |
| 11,401,656 | B2 * | 8/2022 | Clement | B60C 9/0007 |
| 11,458,772 | B2 * | 10/2022 | Clement | D07B 1/0613 |
| 11,535,982 | B2 * | 12/2022 | Clement | D07B 1/0613 |
| 11,578,459 | B1 * | 2/2023 | Clement | B60C 9/0007 |
| 11,591,750 | B2 * | 2/2023 | Clement | D07B 1/0626 |
| 2017/0210169 | A1 | 7/2017 | Nozaki | |
| 2023/0250580 | A1 * | 8/2023 | Chevalley | D07B 1/0613 523/222 |
| 2023/0313453 | A1 * | 10/2023 | Chevalley | D07B 1/0613 57/200 |

FOREIGN PATENT DOCUMENTS

| | | | |
|---|---|---|---|
| JP | 6-173179 | A | 6/1994 |
| WO | 2016/017655 | A1 | 2/2016 |

* cited by examiner

TWO-LAYER MULTI-STRAND CABLE HAVING AN IMPROVED SURFACE ENERGY-TO-BREAK

BACKGROUND

The invention relates to cords and to a tyre comprising these cords.

A tyre for a construction plant vehicle, having a radial carcass reinforcement comprising a tread, two inextensible beads, two sidewalls connecting the beads to the tread and a crown reinforcement, disposed circumferentially between the carcass reinforcement and the tread, is known from the prior art, notably from document WO2016017655. This crown reinforcement comprises four plies reinforced by reinforcing elements such as metal cords, the cords of one ply being embedded in an elastomer matrix of the ply.

This crown reinforcement comprises several working plies comprising several filamentary reinforcing elements. Each working filamentary reinforcing element is a two-layer multi-strand cord having an internal layer of the cord made up of K=1 two-layer internal strand comprising an internal layer made up of Q=3 internal metallic threads of diameter d1=0.25 mm and an external layer made up of N=8 external metallic threads of diameter d3=0.33 mm wound around the internal layer; an external layer of the cord made up of L=6 two-layer external strands comprising an internal layer made up of Q'=3 internal metallic threads of diameter d1'=0.29 mm and an external layer made up of N'=9 external metallic threads of diameter d3'=0.29 mm wound around the internal layer. The diameter of the unwrapped cord is equal to 3.72 mm for a force at break of 17 572 N.

On the one hand, as the tyre passes over obstacles, for example in the form of rocks, these obstacles risk perforating the tyre as far as the crown reinforcement. These perforations allow corrosive agents to enter the crown reinforcement of the tyre and reduce the life thereof.

On the other hand, it has been found that the cords of the crown plies may exhibit breakages resulting from relatively significant deformations and loads applied to the cord, notably as the tyre passes over obstacles.

SUMMARY

One subject of the invention is a cord that makes it possible to reduce, or even to eliminate, the number of breakages and the number of perforations.

DETAILED DESCRIPTION

To this end, one subject of the invention is a two-layer multi-strand cord comprising:

- an internal layer of the cord made up of K=1 two-layer internal strand comprising:
- an internal layer made up of Q=2, 3 or 4 internal metallic threads, and
- an external layer made up of N external metallic threads of diameter d3 wound around the internal layer,
- an external layer of the cord made up of L>1 two-layer external strands wound around the internal layer of the cord, comprising:
- an internal layer made up of Q'=2, 3 or 4 internal metallic threads, and

- an external layer made up of N' external metallic threads of diameter d3' wound around the internal layer, in which the cord has an energy-to-break per unit area ES≥150 N·mm$^{-1}$ with $$ES = \sum_{i=1}^{Nc} F_{mi} \times \sum_{i=1}^{Nc} A_{ti}/Nc \times Cfrag/D$$

where:

$$\sum_{i=1}^{Nc} F_{mi}$$

is the sum of the forces at break for the Nc threads, in Newtons;

Nc=Q+N+L×(Q'+N') is the total number of metallic threads;

D is the diameter of the cord, in mm;

$$\sum_{i=1}^{Nc} A_{ti}$$

is the sum of the total elongation of the Nc threads, and is dimensionless;

Cfrag is the dimensionless coefficient of weakening of the cord, with $$C_{frag} = 1 - \left( \frac{\sin(\alpha_f)}{d3 \times d3'} \times \frac{\left(\sum_{i=1}^{Q'+N'} F_{mi}\right) \times \sin(\alpha t)}{N \times Cste} \right)$$

where:

d3 and d3' are expressed in mm,

αf is the angle of contact between the external metallic threads of the internal strand and the external metallic threads of the external strands, expressed in radians, αt is the helix angle of each external strand (TE) expressed in radians;

Cste=1500 N·mm$^{-2}$.

Because it has a relatively high energy-to-break per unit area, the cord according to the invention makes it possible to reduce perforations and therefore lengthen the life of the tyre and also reduce the number of breakages. Specifically, the inventors behind the invention have discovered that the determining criterion for reducing cord breakages was not only the force at break as widely taught in the prior art, but the energy-to-break per unit area which in the present application is represented by an indicator equal to the product of the force at break, the elongation at break, and the coefficient of weakening of the cord, divided by the diameter of the cord.

The coefficient of weakening makes it possible to take account of the loss of tensile behaviour of the cord caused by transverse weakening in inter-thread contacts at the level of the external metallic threads of the internal layer and of the external layer. This coefficient of weakening is dependent on the number of external metallic threads in the internal layer, on the angle of contact between the internal strand and the or each external strand, on the diameters d3 and d3' of the external metallic threads of the internal layer and of the external metallic threads of the external layer, respectively, on the helix angle of an external strand and on the force at break of an external strand. Thus, a robust cord will have a coefficient of weakening close to 1 and a weakened cord will have a suboptimal coefficient of weakening rather closer to 0.5.

Specifically, the cords of the prior art have either a force at break that is relatively high but a coefficient of weakening that is not optimal, or an optimal coefficient of weakening, namely one close to 1, but a force at break that is relatively low, such as Example 8 of WO2016017655. In both instances, the cords of the prior art have a relatively low energy-to-break per unit area. The cord according to the invention, because of its relatively high coefficient of weakening and its relatively high force at break, exhibits an elongation at break that is relatively high and a relatively high energy-to-break per unit area.

Any range of values denoted by the expression "between a and b" represents the range of values extending from more than a to less than b (namely excluding the end-points a and b), whereas any range of values denoted by the expression "from a to b" means the range of values extending from the end-point "a" as far as the end-point "b", namely including the strict end-points "a" and "b".

By definition, the diameter of a strand is the diameter of the smallest circle inside which the strand is circumscribed.

Advantageously, the diameter of the cord is the diameter of the smallest circle inside which the cord without the wrapper is circumscribed. For preference, the cord has a diameter D such that D≤6.0 mm, preferably such that 5.0 mm≤D≤5.5 mm. The diameter D is measured on the cord in accordance with standard ASTM D2969-04.

In the invention, the cord has two layers of strands, which means to say that it comprises an assembly made up of two layers of strands, neither more nor less, which means to say that the assembly has two layers of strands, not one, not three, but only two.

In one embodiment, the internal strand of the cord is surrounded by a polymer compound followed by the external layer.

Advantageously, the internal strand has cylindrical layers.

Advantageously, each external strand has cylindrical layers.

Highly advantageously, the internal strand and each external strand have cylindrical layers. It will be recalled that such cylindrical layers are obtained when the various layers of the strand are wound at different pitches and/or when the directions of winding of these layers differ from one layer to the other. A strand with cylindrical layers is very highly penetrable, unlike a strand with compact layers in which the pitches of all the layers are the same and the directions of winding of all the layers are the same, thereby exhibiting far lower penetrability.

The internal strand is a two-layer strand. The internal strand comprises a collection of threads which is made up of two layers of threads, neither more nor less, which means to say that the collection of threads has two layers of threads, not one, not three, but only two.

The external strand is a two-layer strand. The external strand comprises a collection of threads which is made up of two layers of threads, neither more nor less, which means to say that the collection of threads has two layers of threads, not one, not three, but only two.

It will be recalled that, as is known, the pitch of a strand represents the length of this strand, measured parallel to the axis of the cord, after which the strand that has this pitch has made a complete turn around the said axis of the cord. Similarly, the pitch of a thread represents the length of this thread, measured parallel to the axis of the strand in which it is located, after which the thread that has this pitch has made a complete turn around the said axis of the strand.

What is meant by the direction of winding of a layer of strands or of threads is the direction that the strands or the threads form with respect to the axis of the cord or of the strand. The direction of winding is commonly designated by the letter Z or S.

The pitches, directions of winding, and diameters of the threads and of the strands are determined in accordance with standard ASTM D2969-04 of 2014.

The angle of contact between the external metallic threads of the internal strand and the external metallic threads of the external strands is the angle $\alpha f$ indicated in FIG. 7. In this schematic depiction of the cord according to the invention, the axis A-A' of the cord, around which the internal layer and the external layer are wound, has been indicated. In this depiction, only 2 metallic threads of the external layer of the external strand have been retained, in order better to see the angle $\alpha f$ which is the angle of contact between the external metallic thread of the internal strand and the external metallic thread of the external strand. This is one of the relevant parameters in determining the coefficient of weakening of the cord because the smaller the angle of contact the less the weakening of the cord.

The helix angle of each external strand $\alpha t$ is a parameter well known to those skilled in the art and can be determined using the following calculation: $\tan \alpha t = 2 \times \pi \times Re/Pe$, in which formula pe is the pitch expressed in millimetres at which each external strand is wound, re is the radius of the helix of each external strand, expressed in millimetres, and tan refers to the tangent function. $\alpha t$ is expressed in degrees.

By definition, the helix radius Re of the external layer of the cord is the radius of the theoretical circle passing through the centres of the external strands of the external layer in a plane perpendicular to the axis of the cord.

The total elongation At, a parameter well known to those skilled in the art, is determined for example by applying standard ASTM D2969-04 from 2014 to a thread that is tested in such a way as to obtain a force-elongation curve. The At is deduced from the curve obtained as being the elongation, in %, corresponding to the projection onto the elongation axis of the point on the force-elongation curve at which the thread breaks, namely the point at which the load increases to a maximum value of force at break (Fm) and then decreases sharply after breakage. When the decrease with respect to Fm exceeds a certain level, that means that breakage of the thread has occurred.

For preference, the strands do not undergo pre-shaping.

Advantageously, the cord is made of metal. The term "metal cord" is understood by definition to mean a cord formed of threads made up predominantly (i.e. more than 50% of these threads) or entirely (100% of the threads) of a metallic material. Such a metallic material is preferably implemented using a material made of steel, more preferably of pearlitic (or ferritic-pearlitic) carbon steel referred to as "carbon steel" below, or else of stainless steel (by definition steel comprising at least 11% chromium and at least 50% iron). However, it is of course possible to use other steels or other alloys.

When a carbon steel is advantageously used, its carbon content (% by weight of steel) is preferably comprised between 0.4% and 1.2%, notably between 0.5% and 1.1%; these contents represent a good compromise between the mechanical properties required for the tyre and the workability of the threads.

The metal or the steel used, whether in particular it is a carbon steel or a stainless steel, may itself be coated with a metal layer which, for example, improves the workability of the metal cord and/or of its constituent elements, or the use properties of the cord and/or of the tyre themselves, such as properties of adhesion, corrosion resistance or resistance to ageing. According to one preferred embodiment, the steel used is covered with a layer of brass (Zn—Cu alloy) or of zinc.

For preference, the threads of the one same layer of a predetermined (internal or external) strand all have substantially the same diameter. Advantageously, the external strands all have substantially the same diameter. What is meant by "substantially the same diameter" is that the threads or the strands have the same diameter to within the industrial tolerances.

Advantageously, the external strands are wound in a helix around the internal strand with a pitch pe ranging from 40 mm to 100 mm and preferably ranging from 50 mm to 90 mm.

The cord according to the invention has an energy per unit area that is greatly improved by comparison with the cord of the prior art which has an energy per unit area of 120 $N \cdot mm^{-1}$. The inventors behind the invention postulate the theory that the more inter-thread contacts there are, more particularly in the inter-strand areas which are the most stressing, namely the more contact there is between the external metallic threads of the internal strand and the external metallic threads of the external strands, the more the weakening load is diluted across the number of contacts. This contact load is dependent on the load that each strand is able to react, namely on the cord loading divided by the number of strands. In order to optimize these contacts, the inventors behind the invention are postulating the theory that it is necessary to have good geometric properties in the contact and more specifically in the angle of contact between the external metallic threads of the internal strand and the external metallic threads of the external strands in order to optimize the contacts inside the cord.

Advantageously, $ES \geq 160\ N \cdot mm^{-1}$, for preference $ES \geq 165\ N \cdot mm^{-1}$ and more preferably $ES \geq 170\ N \cdot mm^{-1}$.

Advantageously, the force at break $$Fr = \sum_{i=1}^{Nc} F_{mi} \times Cfrag$$

is such that Fr≥25 000 N, for preference Fr≥26 000 N and more preferably Fr≥28 000 N. The force at break is measured in accordance with standard ASTM D2969-04. As described above, the cord has a relatively high force at break so as to maximize the energy-to-break per unit area.

Another subject of the invention is a cord extracted from a polymer matrix, the cord comprising:

an internal layer of the cord made up of K=1 two-layer internal strand comprising:

an internal layer made up of Q=2, 3 or 4 internal metallic threads, and an external layer made up of N external metallic threads of diameter d3 wound around the internal layer, an external layer of the cord made up of L>1 two-layer external strands wound around the internal layer of the cord, comprising:

an internal layer made up of Q'=2, 3 or 4 internal metallic threads, and an external layer made up of N' external metallic threads of diameter d3' wound around the internal layer, in which the extracted cord has an energy-to-break $ES' \geq 150\ N \cdot mm^{-1}$ with $$ES' = \sum_{i=1}^{Nc} F_{mi} \times \sum_{i=1}^{Nc} A_{ti} / Nc \times Cfrag' / D$$

where:

$$\sum_{i=1}^{Nc} F_{mi}$$

is the sum of the forces at break for the Nc threads, in Newtons;

Nc=Q+N+L×(Q'+N') is the total number of metallic threads;

D is the diameter of the cord, in mm;

$$\sum_{i=1}^{Nc} A_{ti}$$

is the sum of the total elongation of the Nc threads, and is dimensionless;

Cfrag' is the dimensionless coefficient of weakening of the cord, with $$C'_{frag} = 1 - (2 - Cp) \times \left( \frac{\sin(\alpha_f)}{d3 \times d3'} \times \frac{\left(\sum_{i=1}^{Q'+N'} F_{mi}\right) \times \sin(\alpha t)}{N \times Cste} \right)$$

where:

Cp is the penetration coefficient for the cord d3 and d3' are expressed in mm,

αf is the angle of contact between the external metallic threads of the internal strand and the external metallic threads of the external strands, expressed in radians, αt is the helix angle of the external strands, expressed in radians;

Cste=1500 $N \cdot mm^{-2}$.

For preference, $ES' \geq 155\ N \cdot mm^{-1}$, and more preferably $ES' \geq 160\ N \cdot mm^{-1}$.

The total elongation At of the extracted cord is measured in a similar way to the total elongation At of the cord defined hereinabove.

For preference, the extracted cord has a diameter D such that D≤6.0 mm, preferably such that 5.0 mm≤D≤5.5 mm. The diameter D is measured on the extracted cord in accordance with standard ASTM D2969-04.

The coefficient of weakening Cfrag' takes account of the extent to which the polymer matrix penetrates the cord, through use of the inter-strand penetration coefficient Cp. In order to calculate this penetration coefficient, a transverse cross section is performed on the cord extracted using a saw. This operation is repeated ten times in order to obtain ten transverse cross sections on which a mean penetration coefficient Cp will be calculated. An electron microscope is then used to observe the regions of filling with the polymer compound of each extracted cord, using image-processing software to quantify the ratio of the non-metal surface area without polymer compound to the surface area filled with polymer compound in the zone Scp depicted in FIG. 8 of contact between the external strands and the internal strand. Thus, a well-penetrated cord will have a penetration coefficient close to 1 and a cord that is less well penetrated will have a penetration coefficient close to 0.5.

For preference, the polymer matrix is an elastomer matrix.

The polymer matrix, preferably elastomer matrix, is based on a polymer, preferably elastomer, compound.

What is meant by a polymer matrix is a matrix containing at least one polymer. The polymer matrix is thus based on a polymer compound.

What is meant by an elastomer matrix is a matrix containing at least one elastomer. The preferred elastomer matrix is thus based on the elastomer compound.

The expression "based on" should be understood as meaning that the compound comprises the mixture and/or the product of the in situ reaction of the various constituents used, some of these constituents being able to react and/or being intended to react with one another, at least partially, during the various phases of manufacture of the compound; it being possible therefore for the compound to be in the fully or partially crosslinked state or in the non-crosslinked state.

What is meant by a polymer compound is that the compound contains at least one polymer. For preference, such a polymer may be a thermoplastic, for example a polyester or a polyamide, a thermosetting polymer, an elastomer, for example natural rubber, a thermoplastic elastomer or a combination of these polymers.

What is meant by an elastomer compound is that the compound contains at least one elastomer and at least one other component. For preference, the compound containing at least one elastomer and at least one other component contains an elastomer, a crosslinking system, and a filler. The compounds that can be used for these plies are conventional compounds for the skim coating of filamentary reinforcing elements and comprise a diene elastomer, for example natural rubber, a reinforcing filler, for example carbon black and/or silica, a crosslinking system, for example a vulcanizing system, preferably containing sulfur, stearic acid and zinc oxide, and possibly a vulcanization accelerant and/or retarder and/or various additives. The adhesion between the metallic threads and the matrix in which they are embedded is afforded for example by a metallic coating, for example a layer of brass.

The values of the features described in the present application for the extracted cord are measured on or determined from cords extracted from a polymer matrix, notably an elastomer matrix, for example of a tyre. Thus, for example on a tyre, the strip of material radially on the outside of the cord that is to be extracted is removed in order to be able to see the cord that is to be extracted radially flush with the polymer matrix. This removal can be done by stripping using cutters and grippers, or else by planing. Next, the end of the cord that is to be extracted is uncovered using a knife. The cord is then pulled so as to extract it from the matrix, applying a relatively shallow angle in order not to plasticize the cord that is to be extracted. The extracted cords are then carefully cleaned, for example using a knife, so as to detach any remains of polymer matrix locally adhering to the cord, while taking care not to damage the surface of the metallic threads.

Advantageously, the extracted cord exhibits a force at break Fr' such that $$Fr' = \sum_{i=1}^{Nc} F_{mi} \times Cfrag'$$

such that Fr'≥24 000 N, for preference Fr'≥25 000 N and more preferably Fr'≥27 000 N. The force at break is measured on the extracted cord in accordance with standard ASTM D2969-04.

The advantageous features described hereinbelow apply equally to the cord as defined above and to the extracted cord.

For preference, αf is greater than or equal to 0° and preferably greater than or equal to 5°.

For preference, αf is less than or equal to 25° and preferably less than or equal to 20°.

Over this range of angle of contact ranging from 0° to 25°, the region of contact is maximized and the cord is relatively well penetrated by the polymer compound.

For preference, at is greater than or equal to 0° and preferably greater than or equal to 5°.

For preference, at is less than or equal to 20°, preferably less than or equal to 15° and more preferably less than or equal to 10°.

Over this range of helix angles, the loads of contact between external strands and the internal strand when tension is applied to the cord are minimized.

Advantageously, at least 50% of the metallic threads, preferably at least 60%, more preferably at least 70% of the metallic threads, and highly preferably each metallic thread of the cord comprises a steel core having a composition in accordance with standard NF EN 10020 from September 2000, and a carbon content C>0.80%, preferably C≥0.82%. Such steel compounds combine non-alloyed steels (points 3.2.1 and 4.1 of standard NF EN 10020 from September 2000), stainless steels (points 3.2.2 and 4.2 of standard NF EN 10020 from September 2000) and other alloyed steels (point 3.2.3 and 4.3 of standard NF EN 10020 from September 2000). A relatively high carbon content makes it possible to achieve the mechanical strength of the metallic threads of the cords according to the invention. It would also have been possible to modify the method of manufacture of the metallic threads, notably by work-hardening each metallic thread further, in order to increase the mechanical strength of the metallic threads. Whereas modifying the method of manufacture of the metallic threads involves relatively significant industrial investment, the use of a relatively high carbon content does not require any investment. Furthermore, the use of a relatively high carbon content makes it possible to maintain the bending-compression endurance of the metallic threads, unlike a method in which, by work-hardening the metallic threads further, this bending-compression endurance would be appreciably reduced.

Advantageously, at least 50% of the metallic threads, preferably at least 60%, more preferably at least 70% of the metallic threads, and highly preferably each metallic thread of the cord comprises a steel core having a composition in accordance with standard NF EN 10020 from September 2000, and a carbon content C≤1.20%, preferably C≤1.10%. The use of an excessively high carbon content is, on the one hand, relatively expensive and, on the other hand, leads to a drop in the fatigue-corrosion endurance of the metallic threads.

For preference, d1, d1', d3, d3' range, independently of one another, from 0.25 mm to 0.50 mm, preferably from 0.30 mm to 0.45 mm and more preferably from 0.32 mm to 0.42 mm.

Advantageously, the external layer of the cord is saturated, such that the inter-strand distance of the external strands is strictly less than 20 μm.

By definition, a saturated layer of cord is such that the inter-strand distance for the external strands is strictly less than 20 μm. The inter-strand distance of the external layer of external strands is defined, on a cross section of the cord perpendicular to the main axis of the cord, as being the shortest distance separating, on average, the circular envelopes in which two adjacent external strands are inscribed. Thus, this construction of the cord makes it possible to ensure good architectural stability of the external layer and the saturation of the external layer makes it possible to ensure that the external layer comprises a relatively high number of external strands and therefore exhibits a relatively high force at break.

The inter-strand distance E is the distance between the 2 centres of 2 adjacent external strands, the points A and B as shown in FIG. 9, minus the diameter of the external strand.

For preference, the threads of the one same layer of a predetermined (internal or external) strand all have substantially the same diameter. Advantageously, the external strands all have substantially the same diameter. What is meant by "substantially the same diameter" is that the threads or the strands have the same diameter to within the industrial tolerances.

For that, in an orthonormal 2-D frame of reference, i.e. in the transverse section of the cord, taking OA as being the direction of the abscissa axis where O is the centre of the cord and in instances in which the external strands all have substantially the same diameter, the coordinates of the centres of two strands A and B are calculated: $A=[Re_{TE}, 0]$, $B=[Re_{TE}\times\cos(2\pi/L); Re_{TE}\times\sin(2\pi/L)]$ where L is the number of external strands, and $Re_{TE}$ is the helix radius of each external strand expressed in millimetres.

The helix radius of each external strand is calculated using the following formula: $Re_{TE}=\max(Re_minTE; ReTE\text{-}unsaturated)$, where Re minTE is the winding radius obtained if the layer is oversaturated. This is the minimum radius for which all the strands will be in contact; $Re_min\ TE=1/[(\sin^2(\pi/L)/D_{TE}/2)^2-\cos^2(\pi/L)\times(2\pi/pe)^2]$, where L is the number of external strands, pe is the pitch, expressed in millimetres, at which each external strand is wound, and $D_{TE}$ is the diameter of the external strand in mm; and $Re_{TEunsaturated}$ corresponds to an unsaturated or strictly saturated architecture; $Re_{TEunsaturated}=D_{TI}/2+D_{TE}/2$, where $D_{TI}$ is the diameter of the internal strand in mm and $D_{TE}$ is the diameter of the external strand in mm.

The diameter of the external strand is calculated as follows:

$D_{TE}=2\times Re1'+d1'+2\times d3'$, where Re1' is the winding radius of the internal layer of the external strand, where if the internal layer of the external strand contains just 1 single internal metallic thread: Re1'=0;

otherwise, $Re1'=1/[(\sin^2(\pi/Q')/d1'/2)^2-\cos^2(\pi/Q')\times(2\pi/p1')^2]$ where Q' is the number of metal threads in the internal layer of the external strand, d1' is the diameter of the metal threads of the internal layer of the external strand in mm, and the pitch p1' is the pitch of the internal layer of the external strand in mm.

Next, the distance AB in a frame of reference is calculated using the following formula: $AB=[(xb-xa)^2+(yb-ya)^2]^{1/2}$ and the inter-strand distance is then found, in μm: $E=AB-D_{TE}/\cos(\alpha t)\times 1000$ where $D_{TE}$ is the diameter of the external strand, and $\alpha t=a\tan(2\pi Re_{TE}/pe)$, which is the helix angle of the external strand, where pe is the pitch, expressed in millimetres, at which each external strand is wound.

By contrast, a desaturated layer of cord is such that the inter-strand distance for the external strands is greater than or equal to 20 μm.

Advantageously, the external layer of the internal strand is desaturated.

By definition, a desaturated layer is such that there is enough space left between the threads to allow a polymer compound, preferably an elastomer compound, to pass. A desaturated layer means that the threads do not touch and that there is enough space between two adjacent threads to allow a polymer compound, preferably an elastomer compound, to pass. By contrast, a saturated layer is such that there is not enough space between the threads of the layer to allow a polymer compound, preferably an elastomer compound, to pass, for example because each pair of two threads of the layer touch one another.

By definition, the inter-strand distance of a layer is defined, on a section of the cord perpendicular to the main axis of the cord, as being the shortest distance which, on average, separates two adjacent threads of the layer.

The inter-thread distance of the layer is calculated as follows:

The winding radius for the external layers of the external strands is calculated:

$$Re3'=Re1'+d1/2+d3/2$$

where Re1' is the winding radius of the internal layer of the external strand, as defined hereinabove.

The inter-thread distance I3' is the distance between 2 centres of metal threads minus the thread diameter as shown in FIG. 9, the method of calculation being the same as that used for the external strands:

$$A'=[Re_{3'},0]$$

$$B'=[Re_{3'}\times\cos(2\pi/N');Re3'\times\sin(2\pi/N')]$$

$$A'B'=[(xb'-xa')^2+(yb'-ya')^2]^{1/2}$$

This then gives $I3'=A'B'-d3'/\cos(\alpha C3')\times 1000$, where $\alpha C3'=a\tan(2\pi R3'/p3')$ is the helix angle of the external layer of the external strand.

The sum SI3' is the sum of the inter-thread distances separating each pair of adjacent external threads of the external layer.

Advantageously, the inter-thread distance of the external layer of the internal strand is greater than or equal to 5 μm. For preference, the inter-thread distance of the external layer of the internal strand is greater than or equal to 15 μm, more preferably greater than or equal to 35 μm, more preferably still greater than or equal to 50 μm and highly preferably greater than or equal to 60 μm.

For preference, the inter-thread distance of the external layer of the internal strand is less than or equal to 100 μm.

Advantageously, the sum SI3 of the inter-thread distances 13 of the external layer of the internal strand is greater than the diameter d3 of the external threads of the external layer.

Advantageously, each strand is of the type not rubberized in situ. What is meant by not rubberized in situ is that, prior to the strands being assembled with one another, each strand is made up of the threads of the various layers and does not have any polymer compound, notably any elastomer compound.

Advantageously, the external layer of each external strand is desaturated.

Advantageously, the inter-thread distance of the external layer of each external strand is greater than or equal to 5 μm. For preference, the inter-thread distance of the external layer of each external strand is greater than or equal to 15 μm, more preferably greater than or equal to 35 μm, more preferably still greater than or equal to 50 μm and highly preferably greater than or equal to 60 μm.

For preference, the inter-thread distance of the external layer of each external strand is less than or equal to 100 μm.

Advantageously, the sum SI3' of the inter-thread distances I3' of the external layer of each external strand is greater than or equal to the diameter d3' of the external threads of the external layer.

For preference, each internal metallic thread of the internal strand has a diameter d1 greater than or equal to the diameter d3 of each external metallic thread of the internal strand; for preference $1.00 \leq d1/d3 \leq 1.20$.

For preference, each internal metallic thread of each external strand has a diameter d1' greater than or equal to the diameter d3' of each external metallic thread of each external strand (TE); for preference $1.00 \leq d1'/d3' \leq 1.20$.

In one embodiment, each internal thread has a diameter d1 or d1' respectively greater than or equal to the diameter d3 or d3' of each external thread. The use of diameters such that d1>d3 or d1'>d3' makes it possible to promote the penetrability of the polymer compound, for example the elastomer compound, through the external layer. In another embodiment, in which d1=d3 and d1'=d3', it is possible to limit the number of different threads to be managed in the manufacture of the cord.

For preference, the external layer of the internal strand is wound around the internal layer of the internal strand in contact with the internal layer of the internal strand.

Advantageously, L=6, 7 or 8; for preference L=6 or 7 and more preferably L=6.

For preference, K=1 and L=6. In the cord in which K=1, the most severe transverse loadings are the transverse loadings exerted by the external strands on the internal strand.

Internal Strand of the Cord According to the Invention

In one preferred embodiment, Q>1, for preference Q=2, 3 or 4. In instances in which Q is equal to 1, there would be a risk of seeing the internal thread of the internal strand radially leave the internal strand and even the cord, under the effect of the repeated compressive loadings applied to the cord. Thanks to the presence of several threads in the internal layer of the internal strand (Q>1), this risk is reduced, the compressive loadings then being distributed over the plurality of threads of the internal layer.

Advantageously, N=7, 8, 9 or 10 and for preference N=8 or 9.

In a first alternative form, Q=2 and N=7 or 8, for preference Q=2, N=7.

In a second alternative form, Q=3 and N=7, 8 or 9, for preference Q=3, N=8.

In a third alternative form, Q=4 and N=7, 8, 9 or 10, for preference Q=4, N=9.

Highly advantageously, each internal thread of the internal strand has a diameter d1 equal to the diameter d3 of each external thread of the internal strand. Thus, the same diameter of thread is preferably used in the internal and external layers of the internal strand, thereby limiting the number of different threads that need to be managed during the manufacture of the cord.

External Strands of the Cord According to the Invention

Advantageously, N'=7, 8, 9 or 10 and for preference N'=8 or 9.

In a first alternative form, Q'=2 and N'=7 or 8, for preference Q'=2, N'=7.

In a second alternative form, Q'=3 and N'=7, 8 or 9, for preference Q'=3, N'=8.

In a third alternative form, Q'=4 and N'=7, 8, 9 or 10, for preference Q'=4, N'=9.

Highly advantageously, each internal thread of the external strand has a diameter d1' equal to the diameter d3' of each external thread of the external strand. Thus, the same diameter of thread is preferably used in the internal and external layers of the external strand, thereby limiting the number of different threads that need to be managed during the manufacture of the cord.

Advantageously, Q=4 and N=9, Q'=4 and N'=9, and d1=d3=d1'=d3'.

Reinforced Product According to the Invention

Another subject of the invention is a reinforced product comprising a polymer matrix and at least one cord or extracted cord as defined above.

Advantageously, the reinforced product comprises one or several cords according to the invention embedded in the polymer matrix and, in the case of several cords, the cords are arranged side-by-side in a main direction.

Tyre According to the Invention

Another subject of the invention is a tyre comprising at least one cord or a reinforced product as defined above.

For preference, the tyre has a carcass reinforcement anchored in two beads and surmounted radially by a crown reinforcement which is itself surmounted by a tread, the crown reinforcement being joined to the said beads by two sidewalls, and comprising at least one cord as defined above.

In one preferred embodiment, the crown reinforcement comprises a protective reinforcement and a working reinforcement, the working reinforcement comprising at least one cord as defined hereinabove, the protective reinforcement being interposed radially between the tread and the working reinforcement.

The cord is most particularly intended for industrial vehicles selected from heavy vehicles such as "heavy-duty vehicles"—i.e. underground trains, buses, road haulage vehicles (lorries, tractors, trailers), off-road vehicles, agricultural vehicles or construction plant vehicles, or other transport or handling vehicles.

As a preference, the tyre is for a vehicle of the construction plant type. Thus, the tyre has a size in which the diameter, in inches, of the seat of the rim on which the tyre is intended to be mounted is greater than or equal to 40 inches.

The invention also relates to a rubber item comprising an assembly according to the invention, or an impregnated assembly according to the invention. What is meant by a rubber item is any type of item made of rubber, such as a ball, a non-pneumatic object such as a non-pneumatic tyre casing, a conveyor belt or a caterpillar track.

BRIEF DESCRIPTION OF THE FIGURES

A better understanding of the invention will be obtained on reading the examples which will follow, given solely by way of non-limiting examples and made with reference to the drawings, in which.

EXAMPLE OF A TYRE ACCORDING TO THE INVENTION

Figure 1:
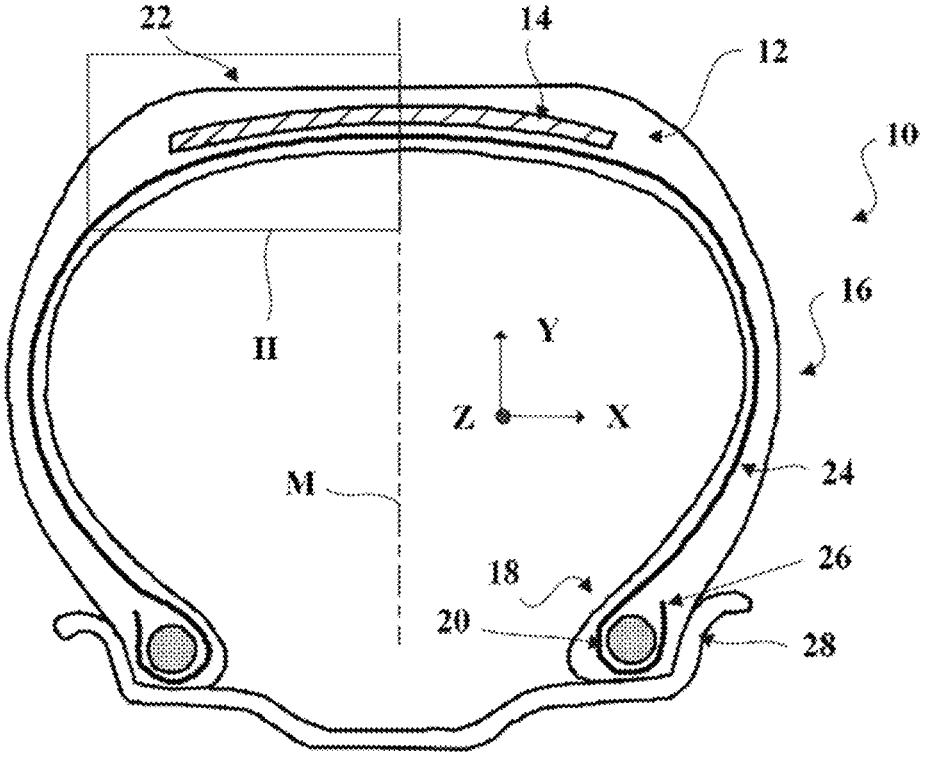
FIG. 1 is a view in cross section perpendicular to the circumferential direction of a tyre according to the invention.
Figure 2:
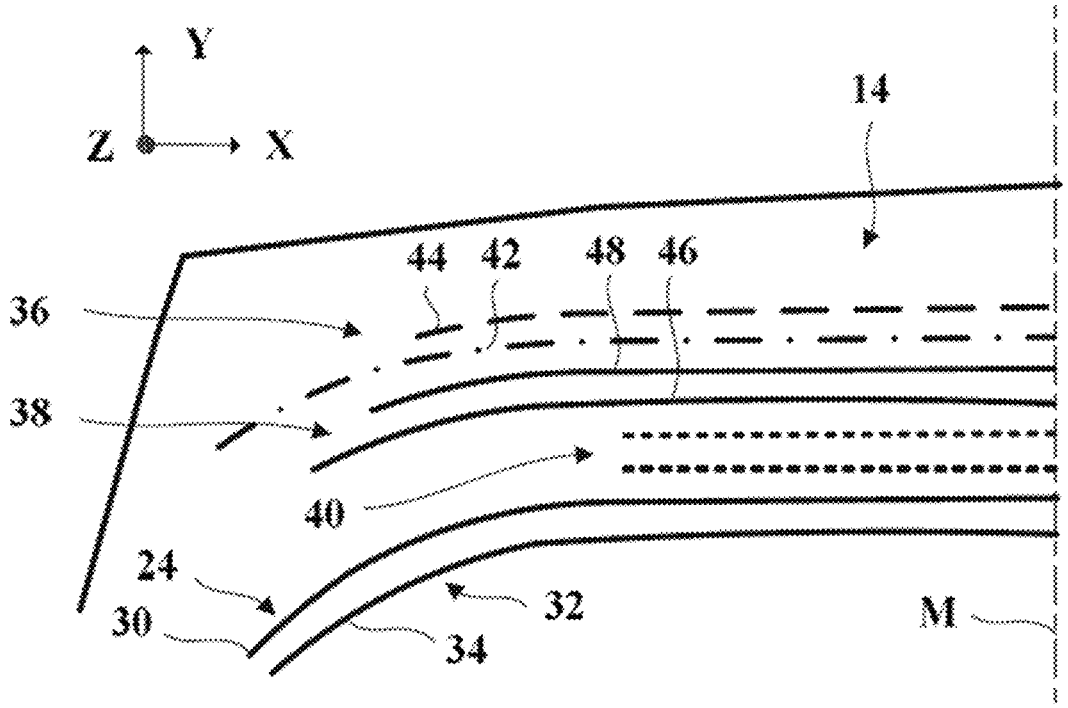
FIG. 2 is a detail view of the region II of FIG. 1.

A frame of reference X, Y, Z corresponding to the usual respectively axial (X), radial (Y) and circumferential (Z) orientations of a tyre has been depicted in FIGS. 1 and 2.

The "median circumferential plane" M of the tyre is the plane which is normal to the axis of rotation of the tyre and which is situated equidistantly from the annular reinforcing structures of each bead.

FIGS. 1 and 2 depict a tyre according to the invention and denoted by the general reference 10.

The tyre 10 is for a heavy vehicle of construction plant type, for example of "dumper" type. Thus, the tyre 10 has a dimension of the type 53180R63.

The tyre 10 has a crown 12 reinforced by a crown reinforcement 14, two sidewalls 16 and two beads 18, each of these beads 18 being reinforced with an annular structure, in this instance a bead thread 20. The crown reinforcement 14 is surmounted radially by a tread 22 and connected to the beads 18 by the sidewalls 16. A carcass reinforcement 24 is anchored in the two beads 18 and in this instance wound around the two bead threads 20 and comprises a turnup 26 positioned towards the outside of the tyre 20, which is shown here fitted onto a wheel rim 28. The carcass reinforcement 24 is surmounted radially by the crown reinforcement 14.

The carcass reinforcement 24 comprises at least one carcass ply 30 reinforced by radial carcass cords (not depicted). The carcass cords are positioned substantially parallel to one another and extend from one bead 18 to the other so as to form an angle comprised between 80° and 90° with the median circumferential plane M (plane perpendicular to the axis of rotation of the tyre which is situated midway between the two beads 18 and passes through the middle of the crown reinforcement 14).

The tyre 10 also comprises a sealing ply 32 made up of an elastomer (commonly known as "inner liner") which defines the radially internal face 34 of the tyre 10 and which is intended to protect the carcass ply 30 from the diffusion of air coming from the space inside the tyre 10.

The crown reinforcement 14 comprises, radially from the outside towards the inside of the tyre 10, a protective reinforcement 36 arranged radially on the inside of the tread 22, a working reinforcement 38 arranged radially on the inside of the protective reinforcement 36 and an additional reinforcement 40 arranged radially on the inside of the working reinforcement 38. The protective reinforcement 36 is thus interposed radially between the tread 22 and the working reinforcement 38. The working reinforcement 38 is interposed radially between the protective reinforcement 36 and the additional reinforcement 40.

The protective reinforcement 36 comprises first and second protective plies 42, 44 comprising protective metal cords, the first ply 42 being arranged radially on the inside of the second ply 44. Optionally, the protective metal cords make an angle at least equal to 10°, preferably in the range from 10° to 35° and more preferably from 15° to 30°, with the circumferential direction Z of the tyre.

The working reinforcement 38 comprises first and second working plies 46, 48, the first ply 46 being arranged radially on the inside of the second ply 48. Each ply 46, 48 comprises at least one cord 50. Optionally, the working metal cords 50 are crossed from one working ply to the other and make an angle at most equal to 60°, preferably in the range from 15° to 40°, with the circumferential direction Z of the tyre.

The additional reinforcement 40, also referred to as a limiting block, the purpose of which is to absorb in part the mechanical stresses of inflation, comprises, for example and as known per se, additional metallic reinforcing elements, for example as described in FR 2 419 181 or FR 2 419 182, making an angle at most equal to 10°, preferably in the range from 5° to 10°, with the circumferential direction Z of the tyre 10.

Example of a Reinforced Product According to the Invention

Figure 3:
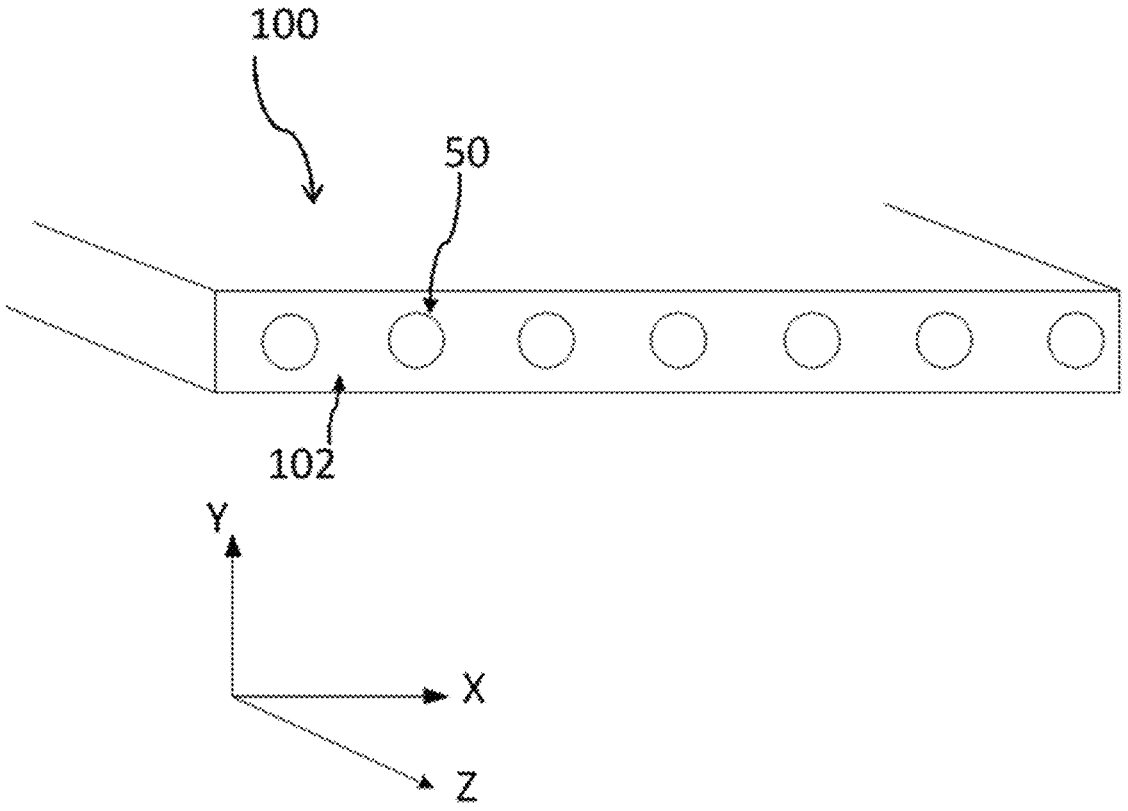
FIG. 3 is a view in cross section of a reinforced product according to the invention.

FIG. 3 depicts a reinforced product according to the invention and denoted by the general reference 100. The reinforced product 100 comprises at least one cord 50, in this instance several cords 50, embedded in the polymer matrix 102.

FIG. 3 depicts the polymer matrix 102, the cords 50 in a frame of reference X, Y, Z, in which the direction Y is the radial direction and the directions X and Z are the axial and circumferential directions. In FIG. 3, the reinforced product 100 comprises several cords 50 arranged side-by-side in the main direction X and extending parallel to one another within the reinforced product 100 and collectively embedded in the polymer matrix 102.

In this instance, the polymer matrix 102 is an elastomer matrix based on an elastomer compound.

Cord According to a First Embodiment of the Invention

Figure 4:
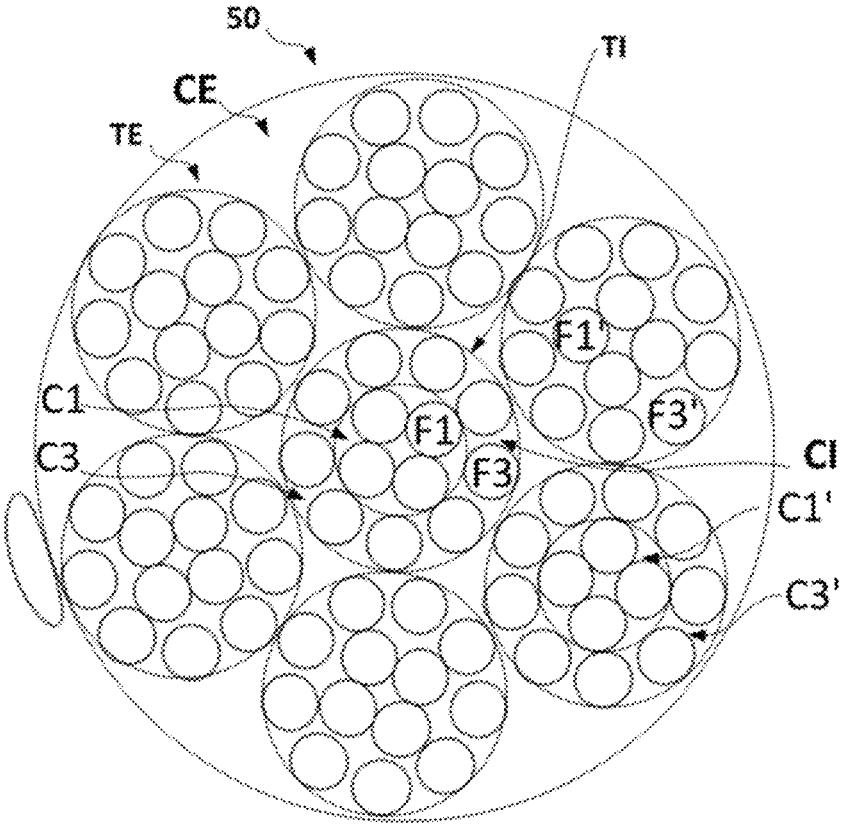
FIG. 4 is a schematic view in cross section perpendicular to the axis of the cord (which is assumed to be straight and at rest) of a cord (50) according to a first embodiment of the invention.

FIG. 4 depicts the cord 50 according to a first embodiment of the invention.

Figure 5:
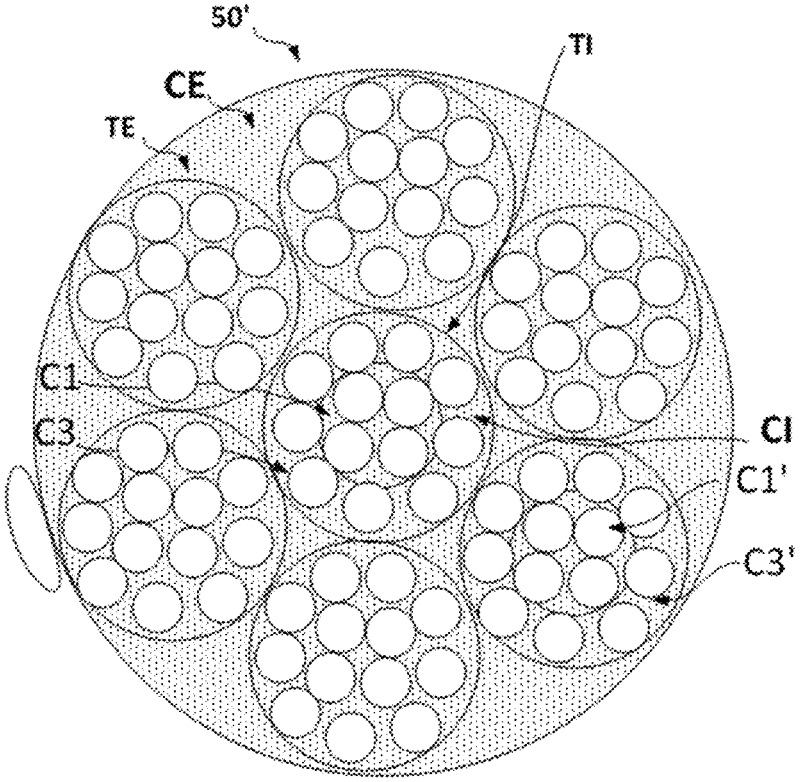
FIG. 5 is a schematic view in cross section perpendicular to the axis of the cord (which is assumed to be straight and at rest) of an extracted cord (50') according to a first embodiment of the invention.

With reference to FIG. 5, each protective reinforcing element 43, 45 and each hoop reinforcing element 53, 55 is formed, once it has been extracted from the tyre 10, of an extracted cord 50' as described below. The cord 50 is obtained by embedding in a polymer matrix, in this instance in a polymer matrix respectively forming each polymer matrix of each protective ply 42, 44 and of each hoop layer 52, 54 in which matrix the protective reinforcing elements 43, 45 and the hoop reinforcing elements 53, 55 are respectively embedded.

The cord 50 and the extracted cord 50' are made of metal and are of the multi-strand type with two cylindrical layers. Thus, it will be understood that there are two layers, not more, not less, of strands of which the cord 50 or 50' is made.

The cord 50 or the cord 50' comprises an internal layer CI of the cord which is made up of K=1 internal strand TI. The external layer CE is made up of L>1 external strands TE wound around the internal layer CI of the cord. In this particular instance, L=6, 7 or 8; for preference L=6 or 7 and more preferably L=6 and here L=6.

The cord 50 has an energy-to-break per unit area $$ES = \sum_{i=1}^{Nc} F_{mi} \times \sum_{i=1}^{Nc} A_{ti} \times Cfrag / D = ((4+9+6\times(4+9))\times 401)\times 0.0282\times \left(1-\left(\frac{\sin(18.9\times\pi/180)}{0.40\times 0.40}\times\frac{(4+9)\times 401\times\sin(9.1\times\pi/180)}{9\times 1500}\right)\right)\Big/5.3 = 91\times 401\times 0.0282\times 0.879/5.3 = 171\ N\cdot mm^{-1}.$$

$$Fr = \sum_{i=1}^{Nc} F_m \times Cfrag = 91\times 401\times 0.879 = 32083N.$$

The cord 50 also comprises a wrapper F (not depicted) made up of a single wrapping thread.

The extracted cord 50' has an energy-to-break per unit area $$ES' = \sum_{i=1}^{Nc} F_m \times \sum_{i=1}^{Nc} A_t \times Cfrag' / D = (91\times 401)\times 0.0282\times(1-(2-0.9))\times \left(\frac{\sin(18.9\times\pi/180)}{0.40\times 0.40}\times\frac{(4+9)\times 401\times\sin(9.1\times\pi/180)}{9\times 1500}\right)\Big/5.3 = 36491\times 401\times 0.0282\times 0.867/5.3 = 168\ N\cdot mm^{-1}.$$

Figure 8:
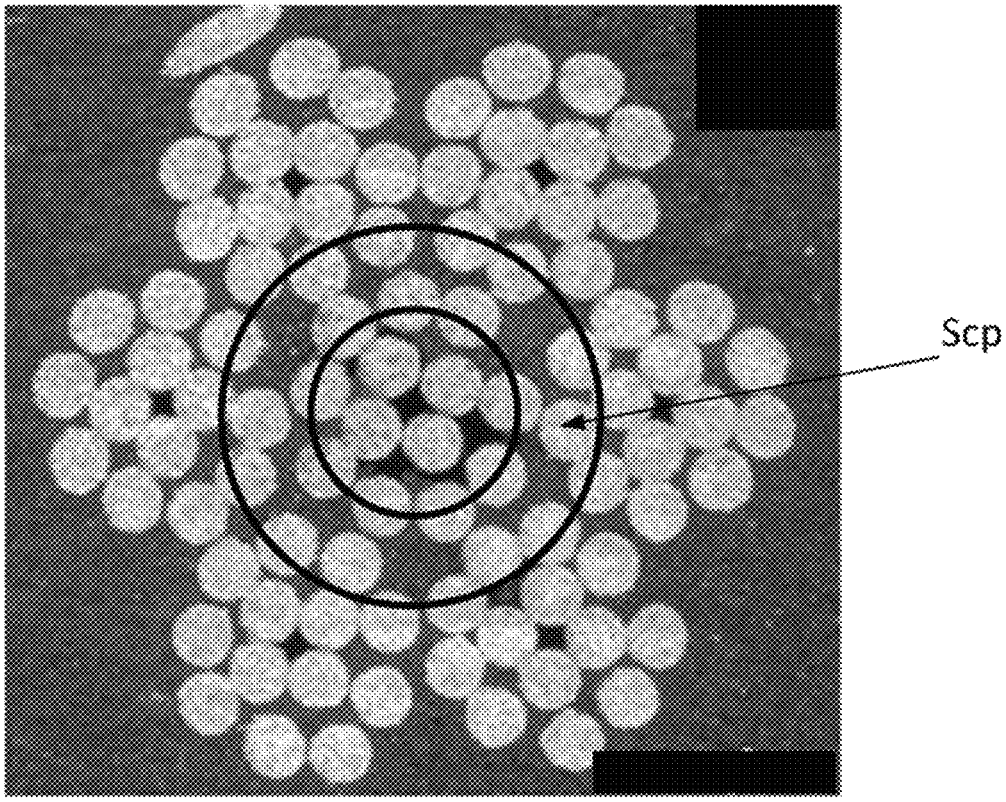
FIG. 8 is a photograph of a cord (50) according to a first embodiment of the invention.
Figure 9:
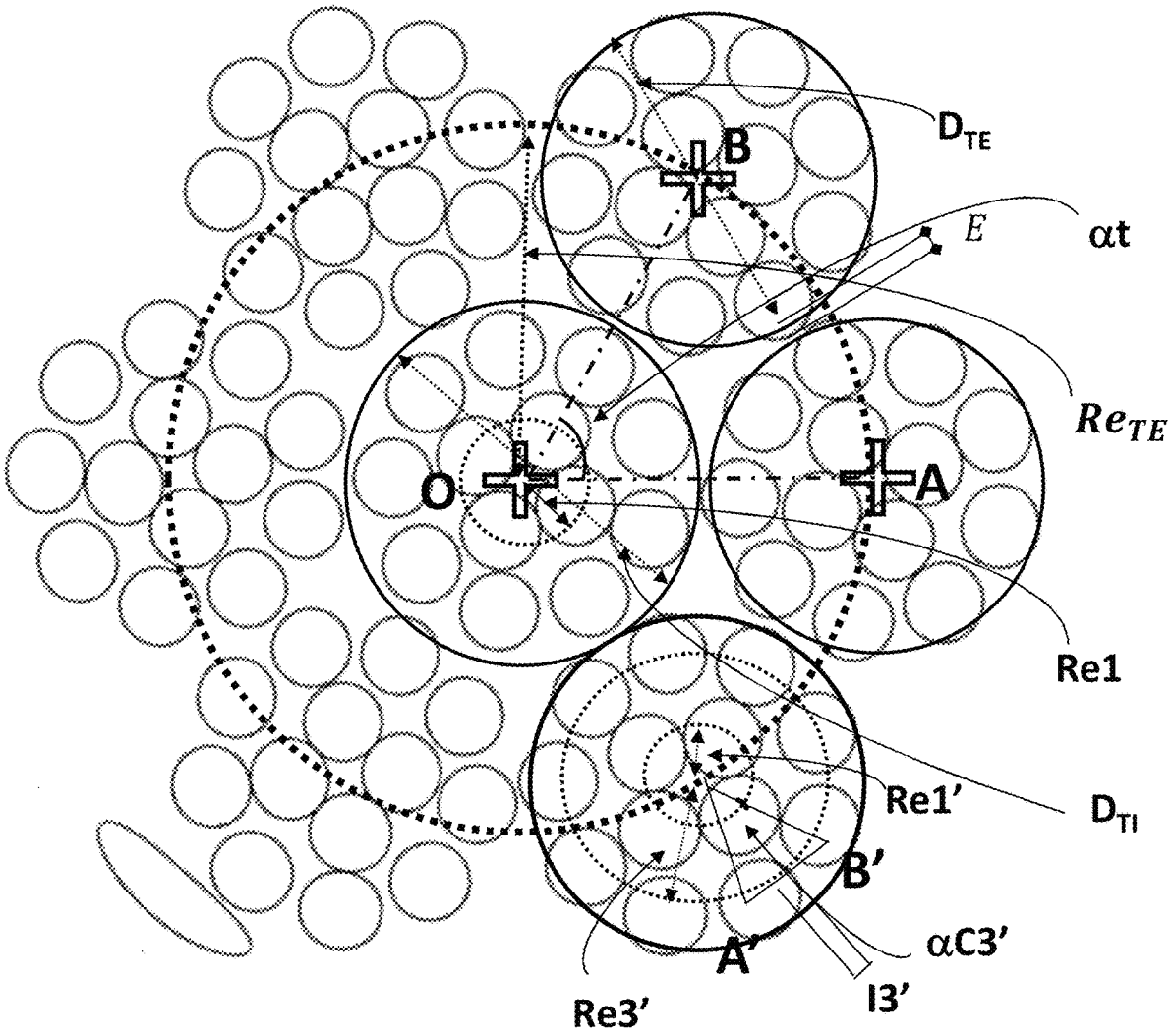
FIG. 9 is a schematic view of different geometric parameters of the cord.

In order to calculate Cp, for example from the photograph in FIG. 8 of the cord 50' in the composite, software is used to determine the ratio of the non-metal surface area without polymer compound to the surface area filled with polymer compound in the zone Scp of contact between the external strands and the internal strand. Here, the ratio averaged over 10 transverse cross sections is equal to 0.9.

$$Fr' = \sum_{i=1}^{Nc} F_m \times Cfrag' = 91\times 401\times 0.867 = 31\ \ 643N.$$

The external layer of the cords 50 and 50' is saturated. Thus, the inter-strand distance E of the external strands is strictly less than 20 μm. Here, E=0 μm.

αf is greater than or equal to 0° and preferably greater than or equal to 5° and less than or equal to 25° and preferably less than or equal to 20°. Here αf=18.9°.

αt is greater than or equal to 0° and preferably greater than or equal to 5° and less than or equal to 20° preferably less than or equal to 15° and more preferably less than or equal to 10°. Here at =9.1°.

Internal Strands TI of the Cords 50 and 50'

Each internal strand TI is a two-layer strand and comprises an internal layer C1 made up of Q=2, 3 or 4 internal metallic threads F1 and an external layer C3 made up of N external metallic threads F3 wound around the internal layer C1.

Here, Q=4.

N=7, 8, 9 or 10 and for preference N=8 or 9, and here N=9.

The external layer C3 of each internal strand TI is desaturated. The inter-thread distance of the external layer of the internal strand is greater than or equal to 15 μm, more preferably greater than or equal to 35 μm, more preferably still greater than or equal to 50 μm and highly preferably greater than or equal to 60 μm and is here equal to 61 μm. The sum SI3 of the inter-thread distances 13 of the external layer C3 is greater than the diameter d3 of the external threads F3 of the external layer C3. Here, the sum SI3=0.061×9=0.55 mm, which is a value greater than d3=0.40 mm.

Each internal and external thread of each internal strand TI respectively has a diameter d1 and d3. Each internal metallic thread F1 of each internal strand TI has a diameter d1 greater than or equal to the diameter d3 of each external metallic thread F3 of each internal strand TI; for preference 1.00≤d1/d3≤1.20.

d1 and d3 range, independently of one another, from 0.25 mm to 0.50 mm, preferably from 0.30 mm to 0.45 mm and more preferably from 0.32 mm to 0.42 mm. Here d1=d3=0.40 mm.

External Strands TE of the Cords 50 and 50'

Each external strand TE has two layers and comprises an internal layer C1' made up of Q'=2, 3 or 4 internal metallic threads F1' and an external layer C3' made up of N' external metallic threads F3' wound around the internal layer C1'.

Here, Q'=4.

N'=7, 8, 9 or 10 and for preference N'=8 or 9, and here N'=9.

The external layer C3' of each external strand TE is desaturated. Because it is desaturated, the inter-thread distance I3' of the external layer C3' which on average separates the N' external threads is greater than or equal to 5 μm. The inter-thread distance I3' of the external layer of each external strand is greater than or equal to 15 μm, more preferably greater than or equal to 35 μm, more preferably still greater than or equal to 50 μm and highly preferably greater than or equal to 60 μm and is here equal to 61 μm. The sum SI3' of the inter-thread distances I3' of the external layer C3' is greater than the diameter d3' of the external threads F3' of the external layer C3'. Here, the sum SI3'=0.061×9=0.55 mm, which is a value greater than d3'=0.40 mm.

Each internal and external layer C1', C3' of each external strand TE is wound in the same direction of winding of the cord and of the internal and external layers C1, C3 of the internal strand TI. Here, the direction of winding of each layer of the cord and of the cord itself is Z.

Each internal and external thread of each external strand TE respectively has a diameter d1' and d3'. Each internal metallic thread F1' of each external strand TE has a diameter d1' greater than or equal to the diameter d3' of each external metallic thread F3' of each external strand TE; for preference 1.00≤d1'/d3'≤1.20.

d1' and d3' range, independently of one another, from 0.25 mm to 0.50 mm, preferably from 0.30 mm to 0.45 mm and more preferably from 0.32 mm to 0.42 mm. Here d1'=d3'=0.40 mm.

The cords 50 and 50' are such that Q=4 and N=9; Q'=4 and N'=9, and d1=d3=d1'=d3'. Here d1=d3=d1'=d3'=0.40 mm.

At least 50% of the metallic threads, preferably at least 60%, more preferably at least 70% of the metallic threads, and highly preferably each metallic thread of the cord comprises a steel core having a composition in accordance with standard NF EN 10020 of September 2000, and a carbon content C>0.80% and preferably C≥0.82% and at least 50% of the metallic threads, preferably at least 60%, more preferably at least 70% of the metallic threads, and highly preferably each metallic thread of the cord comprises a steel core having a composition in accordance with standard NF EN 10020 of September 2000, and a carbon content C≤1.20% and preferably C≤1.10%. Here, each metallic thread comprises a steel core having a composition in accordance with standard NF EN 10020 of September 2000, and a carbon content C=1%.

Each thread has a breaking strength, denoted Rm, such that 2500 Rm 3100 MPa. The steel for these threads is said to be of SHT ("Super High Tensile") grade. Other threads may be used, for example threads of an inferior grade, for example of NT ("Normal Tensile") or HT ("High Tensile") grade, just as may threads of a superior grade, for example of UT ("Ultra Tensile") or MT ("Mega Tensile") grade.

Method for Manufacturing the Cord According to the Invention

One example of a method for manufacturing the multi-strand cord 50 will now be described.

Each aforementioned internal strand is manufactured according to known methods involving the following steps, preferably performed in line and continuously:

first of all, a first step of assembling, by cabling, the Q=4 internal threads F1 of the internal layer C1 at the pitch p1 and in the Z-direction to form the internal layer C1 at a first assembling point;

followed by a second step of assembling, by cabling or by twisting, the N external threads F3 around the Q internal threads F1 of the internal layer C1 at the pitch p3 and in the Z-direction to form the external layer C3 at a second assembling point;

preferably a final twist-balancing step.

Each aforementioned external strand is manufactured according to known methods involving the following steps, preferably performed in line and continuously:

first of all, a first step of assembling, by cabling, the Q'=2, 3 or 4 internal threads F1' of the internal layer C1' at the pitch p1' and in the Z-direction to form the internal layer C1' at a first assembling point;

followed by a second step of assembling, by cabling or by twisting, the N' external threads F3' around the Q' internal threads F1' of the internal layer C1' at the pitch p3' and in the Z-direction to form the external layer C3' at a second assembling point;

preferably a final twist-balancing step.

What is meant here by "twist balancing" is, as is well known to those skilled in the art, the cancellation of the residual torque (or the elastic return of the twist) applied to each thread of the strand, in the intermediate layer as in the external layer.

After this final twist-balancing step, the manufacture of the strand is complete. Each strand is wound onto one or more receiving reels, for storage, prior to the later operation of cabling together the elementary strands in order to obtain the multi-strand cord.

In order to manufacture the multi-strand cord of the invention, the method, as is well known to those skilled in the art, is to cable or twist together the strands previously obtained, using cabling or twisting machines rated for assembling strands.

Thus, the L external strands TE are assembled around the internal strand TI at the pitch pe and in the Z-direction to form the cord 50. Possibly, in a last assembly step, the wrapper F is wound, at the pitch pf and in the S-direction, around the assembly previously obtained.

The cord 50 is then incorporated by calendering into composite fabrics formed from a known compound based on natural rubber and carbon black as reinforcing filler, conventionally used for manufacturing crown reinforcements of radial tyres. This compound essentially contains, in addition to the elastomer and the reinforcing filler (carbon black), an antioxidant, stearic acid, an extender oil, cobalt naphthenate as adhesion promoter, and finally a vulcanization system (sulfur, accelerator and ZnO).

The composite fabrics reinforced by these cords have an elastomer compound matrix formed from two thin layers of elastomer compound which are superposed on either side of the cords and which have a thickness ranging between 1 and 4 mm, respectively. The skim pitch (spacing at which the cords are laid in the elastomer compound fabric) ranges from 4 mm to 8 mm.

These composite fabrics are then used as working ply in the crown reinforcement during the method of manufacturing the tyre, the steps of which are otherwise known to a person skilled in the art.

Cord According to a Second Embodiment of the Invention

Figure 6:
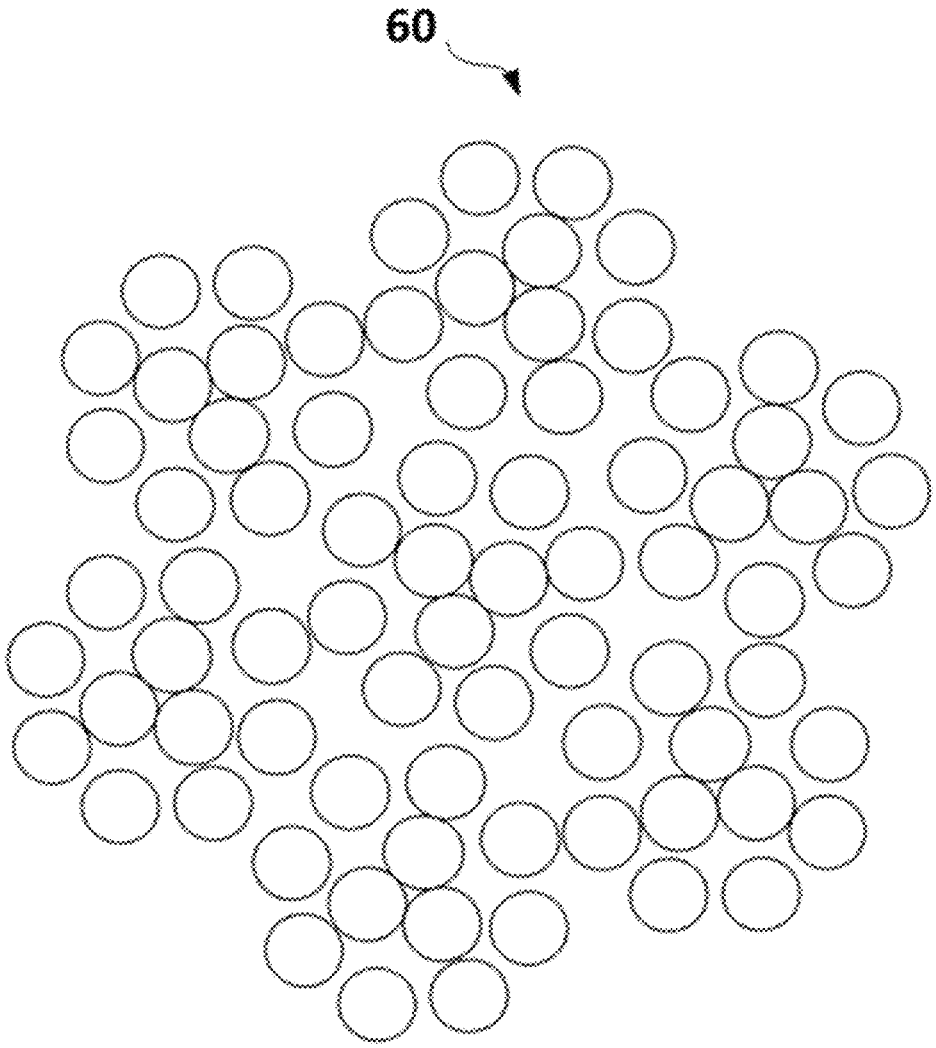
FIG. 6 is a view similar to that of FIG. 4 of a cord (60) according to a second embodiment of the invention.
Figure 7:
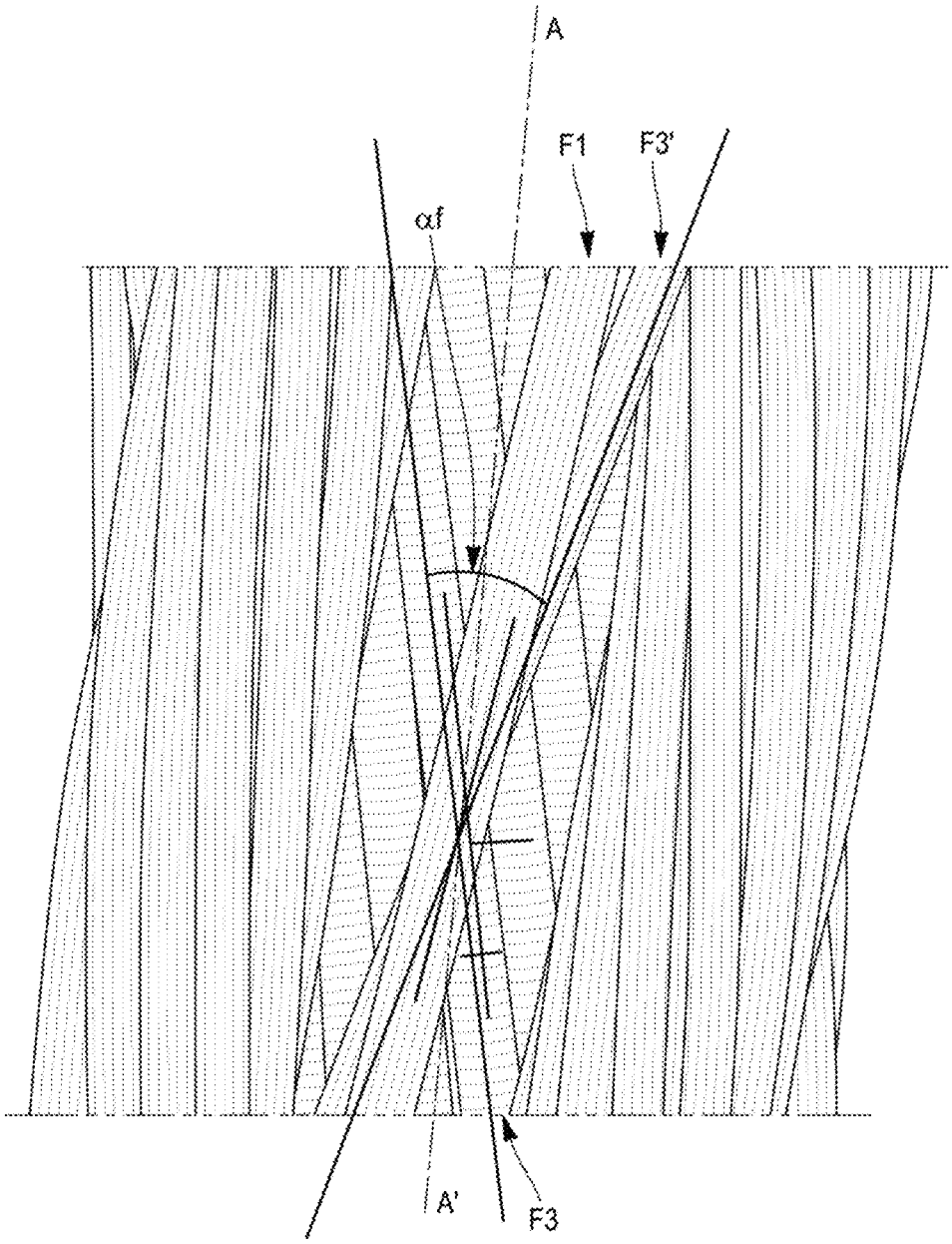
FIG. 7 is a schematic depiction of the angle $\alpha f$ of the cord (50) of FIG. 4.

FIG. 6 depicts a cord 60 according to a second embodiment of the invention.

Unlike in the first embodiment described hereinabove, the cord 60 according to the second embodiment is such that Q=3 and N=8 and Q'=3 and N'=8.

Table 1 below summarizes the characteristics of the various cords 50, 50' and 60.

TABLE 1

| | Cord | 50 | 50' | 60 |
|---|---|---|---|---|
| TI | Q/N | 4/9 | 4/9 | 3/8 |
| | d1/d3 | 0.40/0.40 | 0.40/0.40 | 0.40/0.40 |
| | direction for C1/pitch p1 (mm) | Z/10 | Z/10 | Z/10 |
| | direction for C3/pitch p3 (mm) | Z/20 | Z/20 | Z/20 |
| | I3 (μm)/SI3 (mm) | 61/0.55 | 61/0.55 | 78/0.62 |
| TE | Q'/N' | 4/9 | 4/9 | 3/8 |
| | d1'/d3' | 0.40/0.40 | 0.40/0.40 | 0.40/0.40 |
| | direction for C1'/pitch p1' (mm) | Z/10 | Z/10 | Z/10 |
| | direction for C3'/pitch p3' (mm) | Z/20 | Z/20 | Z/20 |
| | I3' (μm)/SI3' (mm) | 61/0.55 | 61/0.55 | 78/0.62 |
| Direction of cord/pi/pe | | Z/inf/70 | Z/inf/70 | Z/inf/70 |
| K | | 1 | 1 | 1 |
| L | | 6 | 6 | 6 |
| E (μm) | | 0 | 0 | 0 |
| Fm (N) | | 401 | 401 | 401 |
| D (mm) | | 5.3 | 5.3 | 4.9 |
| Thread mean At | | 0.0282 | 0.0282 | 0.0282 |
| Nc | | 91 | 91 | 77 |
| αf (°) | | 18.9 | 18.9 | 5.4 |
| αt (°) | | 9.1 | 9.1 | 8.6 |
| Cfrag | | 0.879 | — | 0.968 |
| Penetration Coeff | | — | 0.9 | — |
| Cfrag' | | — | 0.867 | — |
| Fr (N) | | 32083 | — | 29896 |
| Fr' (N) | | — | 31643 | — |
| ES ($N \cdot mm^{-1}$) | | 171 | — | 173 |
| ES'($N \cdot mm^{-1}$) | | — | 168 | — |

Comparative Tests

Evaluation of the Energy-to-Break Per Unit Area

Various control cords and cords of the prior art were simulated.

Table 2 summarizes the characteristics of the control cord T1 and of the cord of the prior art EDT (Example 8 from WO2016017655).

TABLE 2

| | Cord | EDT | EDT' |
|---|---|---|---|
| TI | Q/N | 3/8 | 3/8 |
| | d1/d3 | 0.33/0.35 | 0.33/0.35 |
| | direction for C1/pitch p1 (mm) | Z/10 | Z/10 |

TABLE 2-continued

| Cord | | EDT | EDT' |
|---|---|---|---|
| | direction for C3/pitch p3 (mm) | Z/20 | Z/20 |
| | I3 (μm)/SI3 (mm) | 53/0.42 | 53/0.42 |
| TE | Q'/N' | 3/9 | 3/9 |
| | d1'/d3' | 0.29/0.29 | 0.29/0.29 |
| | direction for C1'/pitch p1' (mm) | Z/10 | Z/10 |
| | direction for C3'/pitch p3' (mm) | Z/20 | Z/20 |
| | I3' (μm)/SI3' (mm) | 21/0.19 | 21/0.19 |
| Direction of cord/pi/pe | | Z/inf/70 | Z/inf/70 |
| K | | 1 | 1 |
| L | | 6 | 6 |
| E (μm) | | 98 | 98 |
| Fm (N) | | 223 | 223 |
| D (mm) | | 3.7 | 3.7 |
| Thread mean At | | 0.0253 | 0.0253 |
| Nc | | 83 | 83 |
| αf (°) | | 9.0 | 9.0 |
| αt (°) | | 6.7 | 6.7 |
| Cfrag | | 0.938 | — |
| Penetration Coeff | | — | 1 |
| Cfrag' | | — | 0.938 |
| Fr (N) | | 17572 | — |
| Fr' (N) | | — | 17572 |
| ES (N · mm$^{-1}$) | | 120 | |
| ES'(N · mm$^{-1}$) | | — | 120 |

Tables 1 and 2 show that cords 50, 50' and 60 exhibit an energy-to-break per unit area that is improved with respect to the cords of the prior art EDT and EDT'. Specifically, the cords EDT and EDT' have a relatively high coefficient of weakening but a relatively low force at break leading to an energy-to-break per unit area that is not sufficient to reduce the number of breakages and the number of perforations of the cords in the tyre. Thus, the cords according to the invention have an energy-to-break per unit area ES≥150 N·mm$^{-1}$ that is high enough to overcome these disadvantages.

The invention is not limited to the embodiments described above.

The invention claimed is:

1. A two-layer multi-strand cord (50) comprising:

an internal layer CI of the cord made up of K=1 internal strand TI having two layers C1, C3 comprising:

an internal layer C1 of the internal strand TI made up of Q=2, 3 or 4 internal metallic threads F1, and an external layer C3 of the internal strand TI made up of N external metallic threads F3 of diameter d3 wound around the internal layer C1; and an external layer CE of the cord made up of L>1 external strands TE, each external strand TE having two layers C1', C3' wound around the internal layer CI of the cord, comprising:

an internal layer C1' of external strand TE made up of Q'=2, 3 or 4 internal metallic threads F1', and an external layer C3' of external strand TE made up of N' external metallic threads F3' of diameter d3' wound around the internal layer C1' of external strand TE, wherein the cord (50) has an energy-to-break per unit area ES≥155 N·mm$^{-1}$ with $$ES = \sum_{i=1}^{Nc} F_{mi} \times \sum_{i=1}^{Nc} A_{ti}/Nc \times Cfrag/D$$

where:

$$\sum_{i=1}^{Nc} F_{mi}$$

is a sum of forces at break for the Nc threads, in Newtons,

Nc=Q+N+L×(Q'+N') is the total number of metallic threads,

D is the diameter of the cord, in mm, $$\sum_{i=1}^{Nc} A_{ti}$$

is a sum of total elongation of the Nc threads and is dimensionless, and $C_{frag}$ is a dimensionless coefficient of weakening of the cord (50), with $$C_{frag} = 1 - \left( \frac{\sin(\alpha_f)}{d3 \times d3'} \times \frac{\left(\sum_{i=1}^{Q'+N'} F_{mi}\right) \times \sin(\alpha t)}{N \times Cste} \right)$$

where:

d3 and d3' are expressed in mm, $\alpha_f$ is an angle of contact between the external metallic threads F3 of the internal strand TI and the external metallic threads F3' of the external strands TE, expressed in radians, $\alpha_t$ is a helix angle of each external strand TE expressed in radians, and Cste=1500 N·mm$^{-2}$.

2. The cord (50) according to claim 1, wherein ES≥160 N·mm$^{-1}$.

3. The cord (50) according to claim 1, wherein the cord (50) exhibits a force at break $$Fr = \sum_{i=1}^{Nc} F_{mi} \times Cfrag$$

such that Fr≥25,000 N.

4. The cord (50) according to claim 1, wherein $\alpha_f$ is greater than or equal to 0°.

5. The cord (50) according to claim 1, wherein $\alpha_f$ is less than or equal to 25°.

6. The cord (50) according to claim 1, wherein at is greater than or equal to 0°.

7. The cord (50) according to claim 1, wherein at is less than or equal to 20°.

8. The cord (50) according to claim 1, wherein at least 50% of the internal metallic threads F1 of the internal layer C1 of the internal strand TI, the external metallic threads F3 of the external layer C3 of the internal strand TI, the internal metallic threads F1' of the internal layer C1' of each external strand TE, and the external metallic threads F3' of the external layer C3' of each external strand TE comprise a steel core having a composition in accordance with standard NF EN 10020 from September 2000 and a carbon content C>0.80%.

9. The cord (50) according to claim 1, wherein at least 50% of the internal metallic threads F1 of the internal layer C1 of the internal strand TI, the external metallic threads F3 of the external layer C3 of the internal strand TI, the internal metallic threads F1' of the internal layer C1' of each external strand TE, and the external metallic threads F3' of the external layer C3' of each external strand TE comprise a steel core having a composition in accordance with standard NF EN 10020 from September 2000 and a carbon content C≤1.20%.

10. The cord (50) according to claim 1, wherein the external layer CE of the cord is saturated, such that an inter-strand distance of the external strands is strictly less than 20 μm.

11. The cord (50) according to claim 1, wherein the external layer C3 of the internal strand TI is desaturated.

12. The cord (50) according to claim 1, wherein the external layer C3' of each external strand TE is desaturated.

13. A cord (50') extracted from a polymer matrix, the extracted cord (50') comprising:

an internal layer CI of the cord made up of K=1 internal strand TI having two layers C1, C3 comprising:

an internal layer C1 of the internal strand TI made up of Q=2, 3 or 4 internal metallic threads F1, and an external layer C3 of the internal strand TI made up of N external metallic threads F3 of diameter d3 wound around the internal layer C1; and an external layer CE of the cord made up of L>1 external strands TE, each external strand TE having two layers C1', C3' wound around the internal layer CI of the cord, comprising:

an internal layer C1' of external strand TE made up of Q'=2, 3 or 4 internal metallic threads F1', and an external layer C3' of external strand TE made up of N' external metallic threads F3' of diameter d3' wound around the internal layer C1' of external strand TE, wherein the extracted cord (50') has an energy-to-break ES'≥150 N·mm$^{-1}$ with $$ES' = \sum_{i=1}^{Nc} F_{mi} \times \sum_{i=1}^{Nc} A_{ti}/Nc \times C_{frag'}/D$$

where:

$$\sum_{i=1}^{Nc} F_{mi}$$

is a sum of forces at break for the Nc threads, in Newtons,

Nc=Q+N+L×(Q'+N') is the total number of metallic threads,

D is the diameter of the cord, in mm, $$\sum_{i=1}^{Nc} A_{ti}$$

is a sum of total elongation of the Nc threads and is dimensionless, and $C_{frag'}$ is the dimensionless coefficient of weakening of the cord (50'), with $$C'_{frag} = 1 - (2 - Cp) \times \left( \frac{\sin(\propto_f)}{d3 \times d3'} \times \frac{\left(\sum_{i=1}^{Q'+N'} F_{mi}\right) \times \sin(\alpha t)}{N \times Cste} \right)$$

where:

Cp is the penetration coefficient for the cord, d3 and d3' are expressed in mm, $\alpha_f$ is an angle of contact between the external metallic threads F3 of the internal strand TI and the external metallic threads F3' of the external strands TE, expressed in radians, $\alpha_t$ is a helix angle of the external strands TE, expressed in radians, and $C_{ste}$=1500 N·mm$^{-2}$.

14. A reinforced product (100) comprising a polymer matrix (102) and at least one extracted cord (50') according to claim 13.

15. A tire comprising at least one extracted cord (50') according to claim 13.

16. A tire comprising the reinforced product according to claim 14.

* * * * *